US006793306B2

(12) United States Patent
Yazdy

(10) Patent No.: US 6,793,306 B2
(45) Date of Patent: Sep. 21, 2004

(54) NORMALIZATION OF HEAD DRIVER CURRENT FOR SOLID INK JET PRINTHEAD BY CURRENT SLOP ADJUSTMENT

(75) Inventor: Mostafa R. Yazdy, Los Angeles, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/284,558

(22) Filed: Oct. 30, 2002

(65) Prior Publication Data

US 2004/0085373 A1 May 6, 2004

(51) Int. Cl.[7] ..... B41J 29/38
(52) U.S. Cl. ..... 347/12; 310/317
(58) Field of Search ..... 347/9, 10, 11, 347/12, 68; 310/317; 323/315; 360/75

(56) References Cited

U.S. PATENT DOCUMENTS 6,086,190 A 7/2000 Schantz et al. ..... 347/81
6,102,513 A 8/2000 Wen ..... 347/15
6,104,178 A * 8/2000 Sugimoto ..... 323/315
6,305,773 B1 * 10/2001 Burr et al. ..... 347/11
6,382,754 B1 5/2002 Morikoshi et al. ..... 347/11
6,412,923 B1 7/2002 Takahashi ..... 347/68

FOREIGN PATENT DOCUMENTS

JP 9-150505 A * 6/1997 ..... B41J/2/045
JP 2001-150666 A * 6/2001 ..... B41J/2/045

* cited by examiner

*Primary Examiner*—Lamson Nguyen
*Assistant Examiner*—Blaise Mouttet
(74) *Attorney, Agent, or Firm*—Oliff & Berridge, PLC

(57) ABSTRACT

Circuitry for providing a method (semi-analog) for normalization procedure of the Head Driver ASIC is disclosed. The circuitry utilizes current DAC's (Digital-to-Analog Converts) to adjust the amplitudes of the voltages across piezoelectric elements, based on predetermined normalization (calibration) data which are stored in separate latches (a different normalization data for each individual transducer). The transducers all receive their respective calibrated voltage values all at the same time utilizing a single current slope delivered to each. This method provides more simplicity and more accuracy for normalization procedure and results in better performance then using digital circuitry and digital counters.

18 Claims, 4 Drawing Sheets

NORMALIZATION OF HEAD DRIVER CURRENT FOR SOLID INK JET PRINTHEAD BY CURRENT SLOP ADJUSTMENT

CROSS REFERENCE TO RELATED APPLICATION

Attention is directed to copending applications U.S. application Ser. No. 10/284,542, filed Oct. 30, 2002, entitled, "Current Switching Architecture for Head Driver of Solid Ink Jet Print Heads" and U.S. application Ser. No. 10/284,559, filed Oct. 30, 2002, entitled, "Normalization of Head Driver Current for Solid Ink Jet Print Head", both filed concurrently herewith. The disclosures of each of these copending applications are hereby incorporated by reference in their entirety.

BACKGROUND OF THE INVENTION

On Ink Jet Print Heads piezoelectric transducers are used to eject ink drops. Positive and negative voltages in particular waveforms are required for this purpose: the positive voltage to fill the orifices with the ink and the negative voltage to eject the ink drops. The shapes of such waveforms are determined by the type of the ink and the specific characteristics of the print heads. A Head Drive ASIC (HDA) is used to provide such waveforms. The amplitude of the output voltage across each transducer on the print head must be individually adjusted to compensate for sensitivity variations of different piezoelectric elements on the print heads. This can be referred to as "normalization" or "calibration" wherein Head Driver ASIC designs use digital circuitry for the normalization procedure. An alternate method is disclosed which may simplify the circuitry and improve the normalization accuracy.

A simplified block diagram of the circuitry used in prior art Head Driver ASIC and related signal waveforms are shown in FIGS. 1 and 2 respectively. VPP 10 and VSS 12 are the positive and the negative power supplies with voltages in particular shapes as shown. The piezoelectric transducer has a capacitive load and is shown by a capacitor Cpz 14. Two switches, switch S1 16 and switch S2 18, connect the transducer to VPP 10 and VSS 12 respectively. The polarity of a signal, called POL (polarity) 20, determines which power supply (VPP or VSS) is connected to the transducer 14. The output voltage (Vout) 22 across each transducer 14 should reach a specific level determined by a 6-bit data stored in a 6-bit latch 24 as shown in FIG. 1. This allows the voltage across each transducer 14 to be trimmed to a determined value in order to compensate for sensitivity variations of different transducers on the print head. This procedure is called "Normalization" or "Calibration".

Referring once again to FIGS. 1 and 2, assuming that the print data is "1", a signal call SEL (select) 26 goes high at time t1 28, switch S1 16 is closed connecting the output transducer 14 to VPP 10 and the output voltage (Vout) 22 across the transducer 14 follows VPP 10. VPP 10 has a high slope between t1 28 and t2 (fast slew) 30 and after t2 30 slope is lower for normalization purpose. At time t2 30, when the slope of VPP 10 is changed, a signal NOM_CEN (Normalization Counter Enable) 32 goes high and triggers a 6-bit counter 34. The output of the counter 34 is compared to the normalization data (B0B1B2B3B4B5) stored in the 6-bit latch 24 in the delay circuit 36 (shown in FIG. 2) and when it matches that data a signal called NORM_LATCH 38 goes low at time t3 40. So basically the delay circuit 36 generates a signal delayed from t2 30 and the amount of delay is determined by 6-bit data stored in 6-bit latch 24. At this time (t3) 40 the signal NORM_LATCH 38 is used to disconnect the output from VPP 10 and the capacitive load of the transducer 14 keeps the output voltage 22 at this level, so the voltage across the transducer 14 is adjusted by 6-bit normalization data.

At time t4 42 the POL (polarity) signal 20 goes low and switch S2 18 is closed connecting the transducer 14 to negative supply VSS 12 and Vout 22 follows VSS 12. Similarly at time t5 44 the slope of VSS 12 is changed and the 6-bit counter 34 is triggered again and at time t6 46, delayed from t5 44 based on normalization data B0B1B2B3B4B5, the transducer 14 is disconnected from VSS 12 and keeps its voltage at this level. As a result the output voltage 22 shown in FIG. 2 is generated across the transducer 14 which is basically shaped by the predetermined shapes of VSS 12 and VPP 10 and its amplitudes are adjusted by "normalization" data.

SUMMARY OF THE INVENTION

Circuitry for providing a method (semi-analog) for normalization procedure of the Head Driver ASIC is disclosed. The circuitry utilizes current DAC's (Digital-to-Analog Converts) to adjust the amplitudes of the voltages across piezoelectric elements, based on predetermined normalization (calibration) data which are stored in separate latches (a different normalization data for each individual transducer). The transducers all receive their respective calibrated voltage values all at the same time utilizing a single current slope delivered to each. This method provides more simplicity and more accuracy for normalization procedure and results in better performance then using digital circuitry and digital counters.

BRIEF DESCRIPTION OF THE DRAWINGS

The objects, features and advantages of the invention will become apparent upon consideration of the following detailed disclosure of the invention, especially when it is taken in conjunction with the accompanying drawings wherein.

DETAILED DESCRIPTION OF THE DRAWINGS

Figure 1:
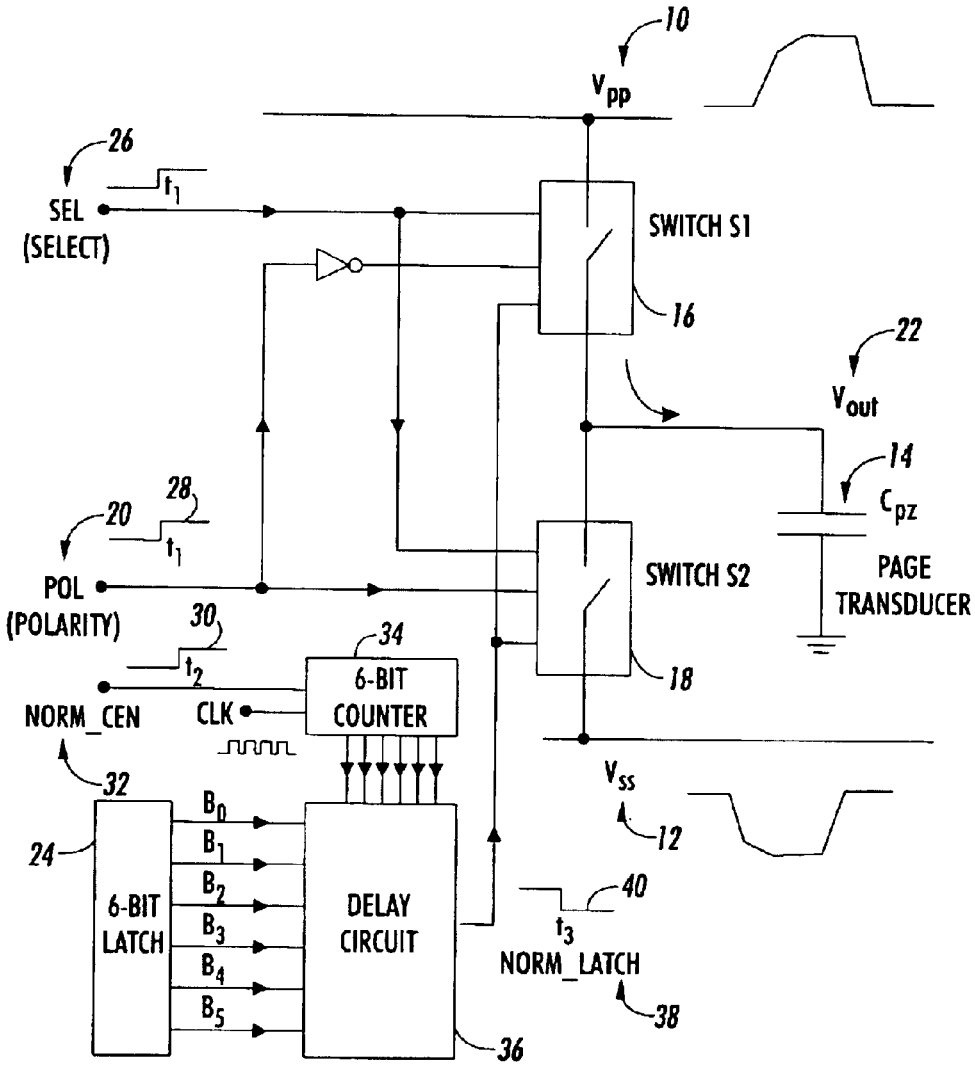
FIG. 1 PRIOR ART
FIG. 1 is a simplified block diagram of prior art circuitry for a head driver.

The circuit shown and described in FIG. 1 utilized 6-bit counters and digital delay circuits (which emulate the "track-and-hold" functions) for normalization procedures. In accordance with the present invention, a new normalization scheme is shown in FIG. 3 and the associated different waveforms of this circuit are shown in FIG. 4.

Figure 2:
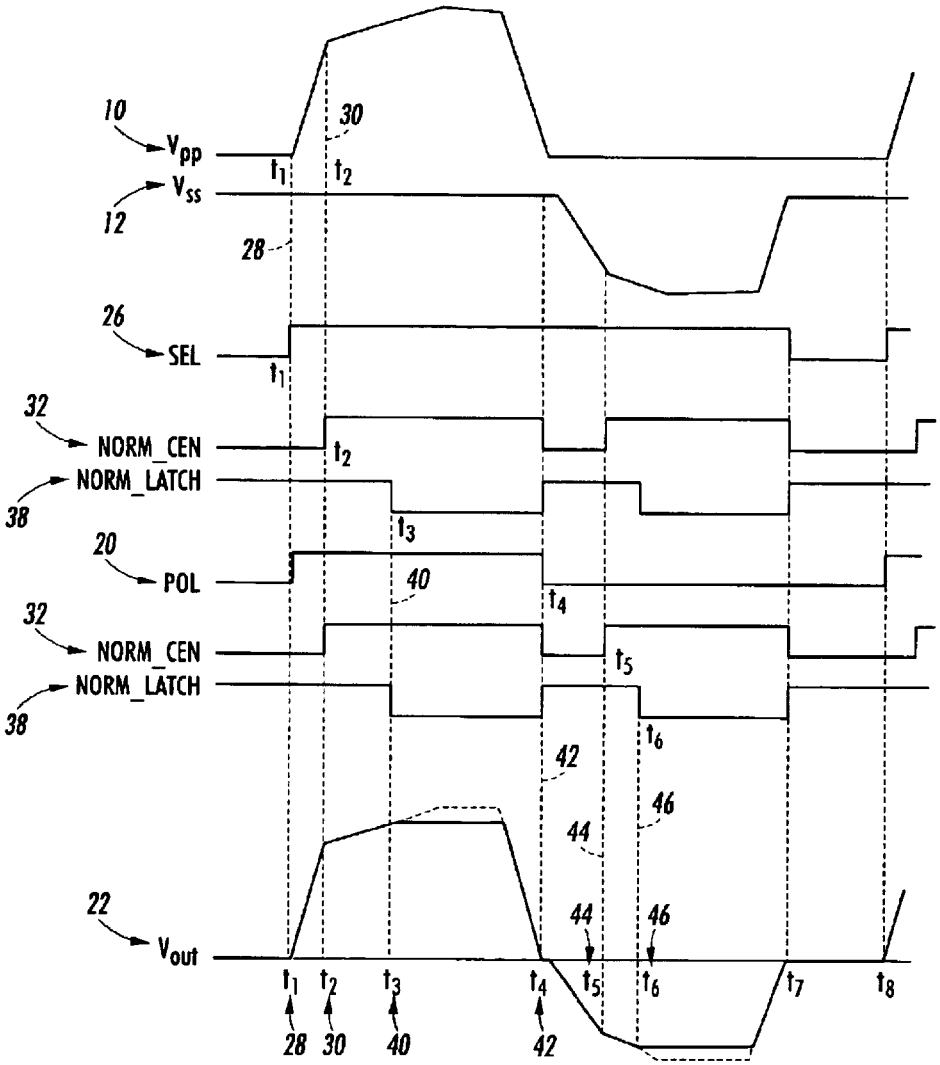
FIG. 2 PRIOR ART
FIG. 2 illustrates the related waveforms for the circuit shown in FIG. 1.
Figure 3:
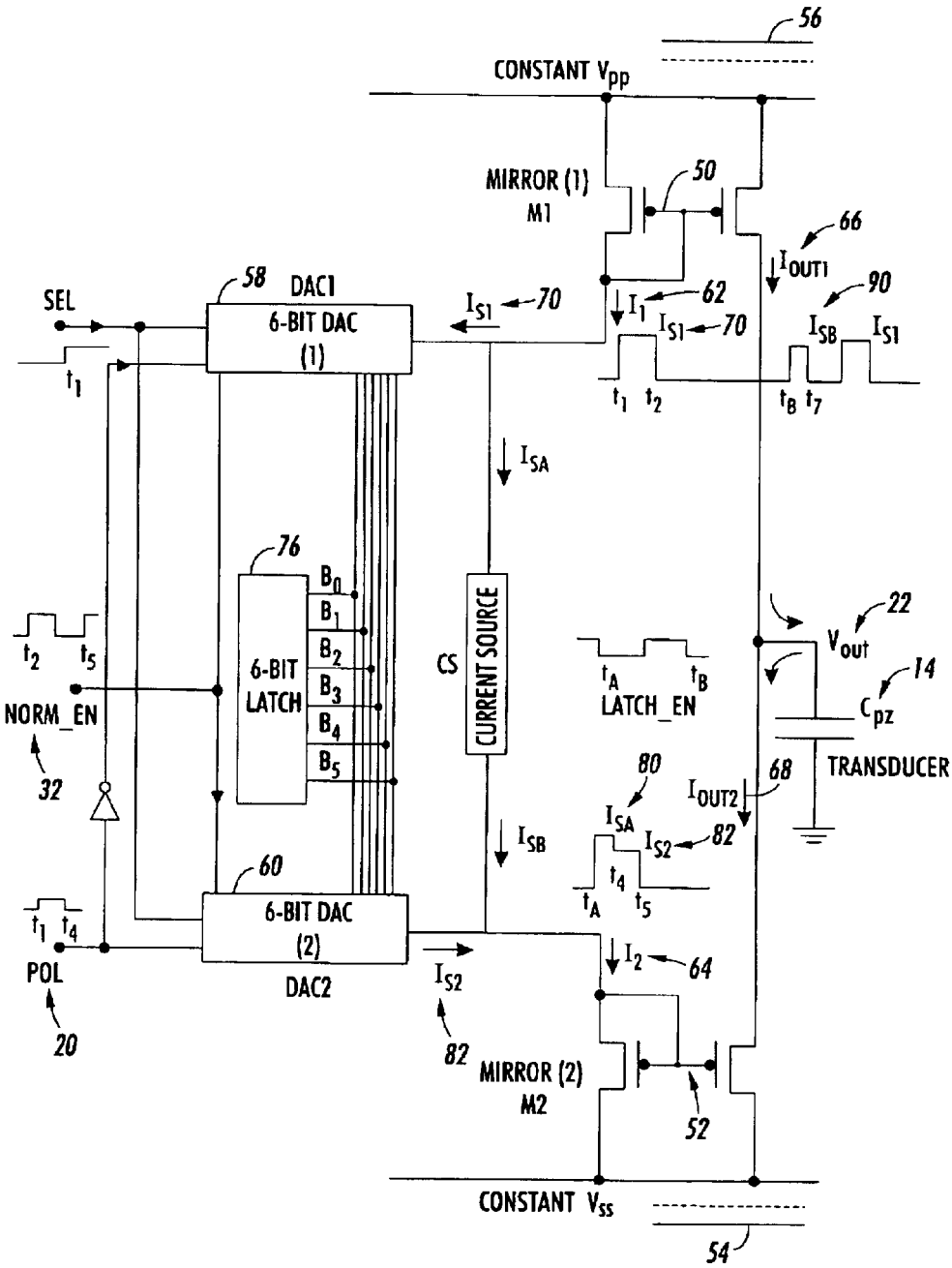
FIG. 3 is a simplified block diagram of circuitry for a head driver in accordance with the present invention.
Figure 4:
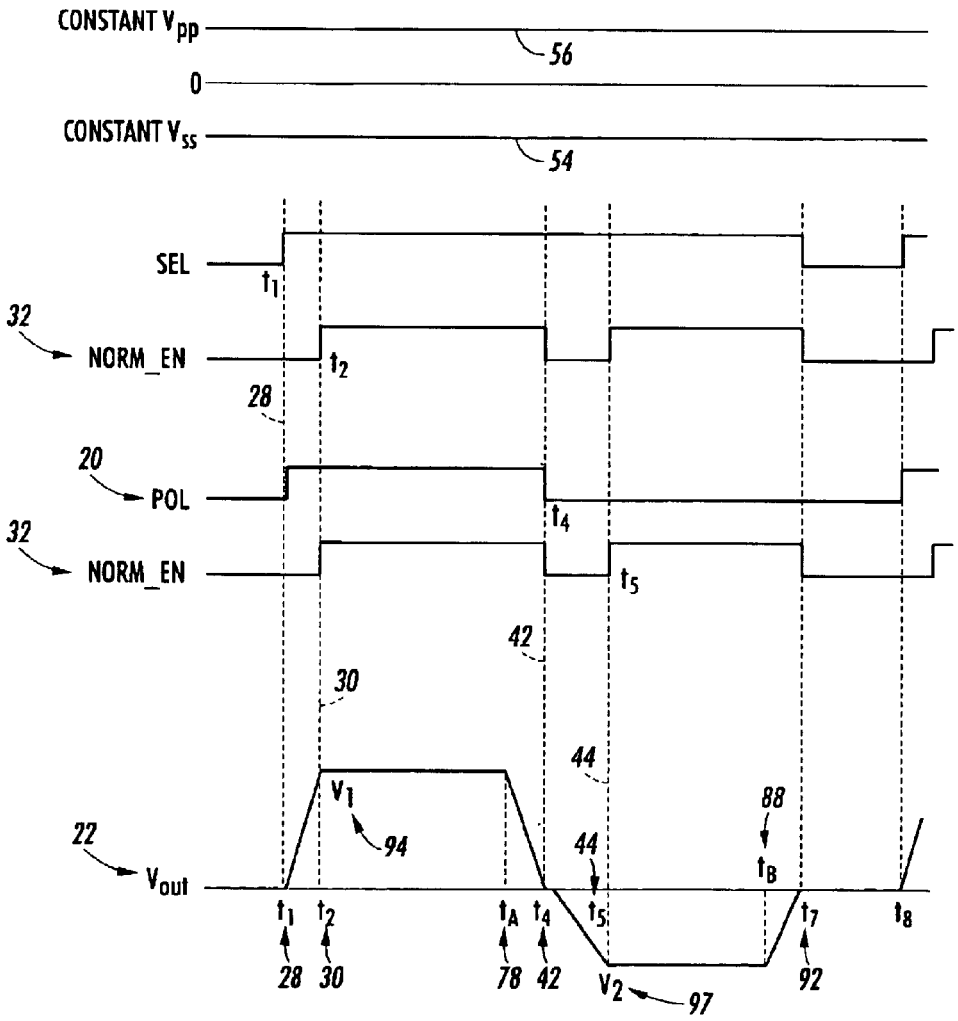
FIG. 4 illustrates the related waveforms for the circuit shown in FIG. 3.

Referring now to FIGS. 3 and 4, two current mirrors M1 50 and M2 52 are used to connect the output transducer to VSS 54 and VPP 56 (constant DC power supplies). Two current DAC's DAC1 58 and DAC2 60 and a current source CS 74, generate the input current I1 62 and I2 64 for current mirrors M1 50 and M2 52 respectively. These two currents are switched to different values at different times and are amplified by mirrors M1 50 and M2 52 to provide output currents Iout1 66 and Iout2 68 and generate an output waveform identical to that of FIG. 2. For example, at t1 28, the value of I1 62 is set to a value of IS1 70 (as shown in FIG. 3). This current is provided by a 6-bit current DAC (DAC1 58) and the value of this current is determined by 6-bit calibration data B5B4B3B2B1B0 stored in a 6-bit latch 76. This current is amplified by Mirror M1 50 and the amplified current Iout1 66 charges the transducer 14 to generate the high slope of Vout 22 between times t1 28 and t2 30. This current generates a voltage Vout 22 across the transducer and hence the slope of Vout 22 between t2 28 and t3 30 is determined by calibration data B5B4B3B2B1B0. At time t2 30, when "NORM_EN" signal 32 goes high, the value of I1 62 (and hence Iout1 66) is reduced to zero and the capacitive load of transducer 14 keeps its voltage Vout 22 at a constant value V1 94. This voltage V1 94 is different for each transducer and its value is controlled by calibration data. At time tA 78 while the current in mirror M1 50 is still zero, the current in mirror M2 52 is set to a value of ISA 80 provided by current source CS 74. This current is amplified by mirror M2 52 and the output current Iout2 68 discharges the output voltage 22 to VSS 54 and generates the negative slope of Vout 22 between times tA 78 and t4 42.

Similarly, when the polarity changes (when POL signal 20 goes low at time t4 42) the current I2 64 in mirror M2 52 is set to IS2 82 to set the high slope part of Vout 22 between t4 42 and t5 44. This current is provided by another 6-bit current DAC (DAC2 60) and its value is determined by 6-bit calibration data B5B4B3B2B1B0 stored in 6-bit latch 76. This current is amplified by Mirror M2 52 and the amplified current Iout2 68 charges the capacitive load of the transducer 14 to generate the high slope of Vout 22 between times t4 42 and time t5 44. This slope is determined by calibration data B5B4B3B2B1B0. At t5 44, when signal "NORM_EN" 32 goes high, the value of I2 64 (and hence Iout2 68) is set to zero and capacitive load of transducer 14 keeps its voltage Vout 22 at a constant value V2 97. So the value of V2 97 is different for each transducer and is determine by calibration data. At time tB 88, while the current in mirror M2 52 is still zero, mirror M1 50 provides a sourcing current ISB 90 to charge up the output until it reaches to a value of zero at time t7 92. At this time the currents in both mirrors M1 50 and M2 52 are zero and the output voltage 22 remains at zero volts.

As shown in FIG. 4, the amplitude of Vout 22 reaches the desired value of V1 94 (in positive side) or V2 97 (in negative side) in only ONE step at a precise times t2 30 (in positive side) or t5 44 (in negative side), while in the prior art (FIGS. 1 & 2) the desired voltages are reached at different times and the slope of different transducers are basically the same and are not adjusted on an individual basis). These two factors result in significantly better uniformity and accuracy of prints. Furthermore, circuits disclosed in this application are much simpler that that of prior art.

While there have been shown and described what are at present considered embodiments of the invention, it will be obvious to those skilled in the art that various changes and modifications may be made therein without departing from the scope of the invention as defined by the appended claims. While the present invention will be described in connection with a preferred embodiment and method of use, it will be understood that it is not intended to it the invention to that embodiment or procedure. On the contrary, it is intended to cover all alternatives, modifications and equivalents as may be included within the spirit and scope of the invention as defined by the appended claims.

What is claimed is:

1. A process for driving piezoelectric transducers within a head driver comprising:

providing first and second current mirrors and a current source for generating a first and second input currents for the first and second current mirrors used to generate a first voltage waveform and a second voltage waveform across capacitive transducers using constant direct current power supplies;

providing an input signal generating data; and generating a signal based on predetermined normalization data stored in separate latches, wherein the transducers all receive their respective signal at a predetermined time by a single slope of current delivered to each.

2. The process according to claim 1, further comprising:

providing the first and second input currents switched to different values at different times and amplified by the first and second mirrors to provide first and second output currents for generating an output waveform.

3. The process according to claim 1, further comprising:

providing, for each transducer, the first voltage waveform by setting a first current value high at a first time setting wherein the first current is amplified by the first current mirror and amplified current charges each transducer to generate a high slope of output voltage between the first time setting and a second time setting.

4. The process according to claim 3, further comprising:

providing the second voltage waveform by reducing the first current value at the second time setting to generate a slow slope part of the output voltage between the second time setting and a third time setting.

5. The process according to claim 4, further comprising:

setting the first current value to zero when the signal is generated.

6. The process according to claim 5, further comprising:

setting the current in the second mirror to a value equal to a predetermined current at a predetermined time while the current in the first current mirror is still zero.

7. The process according to claim 6, further comprising:

generating a negative slope for the output voltage between the predetermined current and predetermined time.

8. The process according to claim 1, wherein the latch is a six bit latch.

9. A system for driving piezoelectric transducers within a head driver comprising:

means for providing first and second current mirrors and a current source for generating a first and second input currents for the first and second current mirrors used to generate a first voltage waveform and a second voltage waveform across capacitive transducers using constant direct current power supplies;

means for generating data; and means for generating a signal based on predetermined normalization data stored in separate latches, wherein the transducers all receive their respective signal at a predetermined time by a single slope of current delivered to each.

10. The system according to claim 9, further comprising:

means for providing the first and second input currents switched to different values at different times and amplified by the first and second mirrors to provide first and second output currents for generating an output waveform.

11. The system according to claim 10, further comprising:

means for providing the first voltage waveform by setting a first current value high at a first time setting wherein said first current is amplified by said first current mirror and amplified current charges each transducer to generate a high slope of output voltage between the first time setting and a second time setting.

12. The system according to claim 11, further comprising:

means for providing the second voltage waveform by reducing the first current value at the second time setting to generate a slow slope part of the output voltage between the second time setting and a third time setting.

13. The system according to claim 12, further comprising:

means for setting the first current value to zero when the signal is generated.

14. The system according to claim 13, further comprising:

means for setting the current in the second mirror to a value equal to a predetermined current at a predetermined time while the current in the first current mirror is still zero.

15. The system according to claim 14, further comprising:

means for generating a negative slope for the output voltage between the predetermined current and predetermined time.

16. The process according to claim 9, wherein the latch is a six bit latch.

17. A circuit utilizing digital to analog converters, comprising:

first and second current mirrors and a current source for generating a first and second input currents for the first and second current mirrors used to generate a first voltage waveform and a second voltage waveform across capacitive transducers using constant direct current power supplies wherein the transducers all receive their respective calibrated voltage values by adjusting the amplitudes of the voltages using digital to analog converters delivering a single slope of current to each; and a generator that generates a signal for each transducer based on bit normalization data stored in a bit latch.

18. The circuit according to claim 17, wherein the bit latch is a six bit latch.

* * * * *

UNITED STATES PATENT AND TRADEMARK OFFICE

CERTIFICATE OF CORRECTION

PATENT NO. : 6,793,306 B2
DATED : September 21, 2004
INVENTOR(S) : Mostafa R. Yazdy It is certified that error appears in the above-identified patent and that said Letters Patent is hereby corrected as shown below:

Title page,
Item [54], Title, please change "NORMALIZATION OF HEAD DRIVER CURRENT FOR SOLID INK JET PRINTHEAD BY CURRENT SLOP ADJUSTMENT" to -- NORMALIZATION OF HEAD DRIVER CURRENT FOR SOLID INK JET PRINTHEAD BY CURRENT SLOPE ADJUSTMENT --

Signed and Sealed this

Eleventh Day of January, 2005

JON W. DUDAS
*Director of the United States Patent and Trademark Office*